US011392091B2

(12) United States Patent
Burger et al.

(10) Patent No.: US 11,392,091 B2
(45) Date of Patent: Jul. 19, 2022

(54) WATCH PIVOT DEVICE

(71) Applicant: ROLEX SA, Geneva (CH)

(72) Inventors: Frédéric Burger, Petit-Lancy (CH); Vanessa Chauveau, Bienne (CH); Aziz Mbaye, Bulle (CH)

(73) Assignee: ROLEX SA, Geneva (CH)

( * ) Notice: Subject to any disclaimer, the term of this patent is extended or adjusted under 35 U.S.C. 154(b) by 830 days.

(21) Appl. No.: 16/047,646

(22) Filed: Jul. 27, 2018

(65) Prior Publication Data

US 2019/0033791 A1 Jan. 31, 2019

(30) Foreign Application Priority Data

Jul. 31, 2017 (EP) ..... 17183962

(51) Int. Cl.
*G04B 31/08* (2006.01)
*G04B 31/008* (2006.01)
*G04B 31/06* (2006.01)

(52) U.S. Cl.
CPC ..... *G04B 31/08* (2013.01); *G04B 31/008* (2013.01); *G04B 31/06* (2013.01)

(58) Field of Classification Search
CPC ..... G04B 31/008; G04B 31/06; G04B 31/08
See application file for complete search history.

(56) References Cited

U.S. PATENT DOCUMENTS 2,636,005 A * 4/1953 Martin, Jr. ..... G04B 31/08 508/501
2,654,990 A 10/1953 Le Van
9,714,469 B2 7/2017 Portet et al.
2003/0050197 A1* 3/2003 Akao ..... C10M 169/044 508/280
2008/0146469 A1* 6/2008 Sato ..... C07C 9/22 508/110

(Continued)

FOREIGN PATENT DOCUMENTS

CH 239786 A 11/1945
CH 287938 A 12/1952

(Continued)

OTHER PUBLICATIONS

LRCB: "Huiles d'horlogerie synthetiques", http://www.lrcb.ch/produits/lubrifiants/presentation_lubrifiants.pdf, Feb. 15, 2015 (w/ English machine translation; 3 pages; cited in the European Search Report).

(Continued)

*Primary Examiner* — Edwin A. Leon
*Assistant Examiner* — Jason M Collins
(74) *Attorney, Agent, or Firm* — WHDA, LLP

(57) ABSTRACT

Method of assembly of a watch pivot device (100) or a watch mechanism (200) or a watch movement (300) or a timepiece (400), the watch pivot device (100) or the watch mechanism (200) or the watch movement (300) or the timepiece (400) comprising a pivot (1) and a bearing (2), the method comprising the following stages: (i) supplying the pivot (1); (ii) supplying the bearing (2); (iii) applying, to at least one surface (101, 102, 211, 221) of the pivot and/or of the bearing, a lubricant of which the kinematic viscosity at a temperature of 20° C. is greater than 1.5 St; and (iv) positioning the pivot in the bearing.

19 Claims, 4 Drawing Sheets

(56) References Cited

U.S. PATENT DOCUMENTS

| | | | | |
|---|---|---|---|---|
| 2008/0194377 | A1* | 8/2008 | Mordukhovich ..... | G04B 13/02 475/331 |
| 2013/0155823 | A1 | 6/2013 | Kaelin et al. | |
| 2013/0287955 | A1 | 10/2013 | Portet et al. | |
| 2015/0003215 | A1* | 1/2015 | Hessler ..... | B23K 26/57 368/131 |
| 2017/0146955 | A1 | 5/2017 | Charbon et al. | |

FOREIGN PATENT DOCUMENTS

| | | | |
|---|---|---|---|
| CH | 704 770 | A2 | 10/2012 |
| CN | 101196725 | A | 6/2008 |
| CN | 103048913 | A | 4/2013 |
| CN | 103163773 | A | 6/2013 |
| CN | 106919036 | A | 7/2017 |
| FR | 1049613 | A | 12/1953 |
| JP | S57-111489 | A | 7/1982 |
| WO | 2012/085130 | A1 | 6/2012 |

OTHER PUBLICATIONS

Moebius: "Huiles", http://www.moebius-lubricants.ch/fr/produits/huiles, Jul. 16, 2017 (in English; 2 pages; cited in the European Search Report).

European Search Report and Written Opinion dated Jun. 13, 2018 issued in counterpart application No. EP17183962; w/ English machine translation (20 pages).

Office Action dated Jan. 14, 2021, issued in counterpart CN Application No. 201810859371.3, with English Translation. (19 pages).

* cited by examiner

WATCH PIVOT DEVICE

This application claims priority of European patent application No. No EP17183962.4 filed Jul. 31, 2017, which is hereby incorporated by reference herein in its entirety.

The invention relates to a watch pivot device. The invention also relates to a watch mechanism comprising a suchlike watch pivot device. The invention further relates to a watch movement comprising a suchlike watch pivot device or a suchlike mechanism. The invention likewise relates to a timepiece comprising a suchlike device or a suchlike mechanism or a suchlike movement. The invention finally relates to a method of assembly or realization of a suchlike pivot device, of a suchlike mechanism, of a suchlike movement or of a suchlike timepiece.

It is known that the oil for the lubrication of the pivot devices of watch oscillators and giving good quality factors is the Synt-A-Lube (SAL) 9010 oil from the manufacturer Moebius. This oil is commonly used at this time for the lubrication of watch oscillators. It has a viscosity of 1.2 St at 20° C. according to the website of the manufacturer http://www.moebius-lubricants.ch/en/produits/huiles.

Conventional pivot devices of watch oscillators, more particularly oscillators of the balance wheel and hairspring type, induce varying degrees of friction on the pivots depending on the position of the oscillator. In general, the friction is higher in the vertical position of the watch, more particularly in the "suspended" position or the "12H position", than in the horizontal position of the movement, more particularly in the "flat" position, also known as the "CH position", with the result that the "quality factor" of the oscillator is lower in the vertical positions than in the horizontal positions of the movement. A difference in the quality factor is reflected by a difference in amplitude for an oscillator of the balance wheel and hairspring type and may be reflected, more particularly, by a difference in the running of the movement, and consequently in the need for precision of the timepiece in order to minimize the difference in the quality factor between the horizontal positions and the vertical positions.

In the entire document, the expressions "CH position", "FH position", "6H position", "12H position" are intended to denote watch positions as defined by the standard ISO 3158.

Known solutions from the prior art involve proposing pivot devices for an oscillator that are configured in such a way as to generate essentially constant forces on the pivots, regardless of the position of the watch. However, these pivot devices require substantive adaptations of the conventional pivot devices, which give full satisfaction with regard to their producibility and shock resistance, however.

In conventional balance wheel pivot devices, the friction in the different positions varies because the configurations of the contact between the pivot and the pivot jewel change. In a horizontal watch position, the axis of the balance wheel is vertical and the tip of the pivot of the axis bears against a jewel known as the counter-pivot. As a general rule, this jewel is plane and the tip of the pivot is rounded, with the result that the resistive torque is low. In a vertical watch position, the axis of the balance wheel is in a horizontal position and rubs against the edge of a hole, in general an olive hole (with rounded edges) disposed in a jewel. The resistive torque is higher, and the amplitude of oscillation of the balance wheel is lower, than in the horizontal position.

In order to address this problem, one solution involves increasing the friction in horizontal positions of the watch by making changes to the conventional balance wheel pivot device. A suchlike solution makes it possible to reduce the differences in friction between the horizontal and vertical positions.

A plurality of embodiments have been proposed in the prior art. Document CH239786, for example, discloses a pivot device combining an olive-hole jewel and an abutment (counter-pivot) inclined in relation to the axis. This makes it possible to induce permanent friction of the cylindrical part of the axis against the olive-hole jewel in horizontal positions, and accordingly to increase the frictional forces or the resistive torques in the horizontal positions.

Document U.S. Pat. No. 2,654,990, for its part, discloses a pivot with a flat tip and with slightly rounded edges rubbing against a counter-pivot equipped with a hemispherical depression. The aim in this case is also to increase the friction in horizontal positions by maximizing the lever arm of the frictional forces in relation to the axis of the balance staff. Likewise, patent application CH704770 proposes a pivot terminated by a bevel for the purpose of increasing the frictional forces or the resistive torques in horizontal positions.

Although these different constructions involve increasing the resistive torque or the friction in horizontal positions of the watch, they more particularly do not permit the resistive torque or the friction to be reduced in vertical positions of the watch. Furthermore, these alternative pivot devices may prove to be fragile or may be subject to premature wear, in addition to having complicated producibility.

The aim of the invention is to make available a watch pivot device making it possible to address the aforementioned shortcomings and to improve the devices that are known from the prior art. In particular, the invention proposes a pivot device in which the difference in the quality factor between the "flat" and "suspended" positions is minimized. The invention also proposes a method for the implementation of a suchlike pivot device.

The method of assembly according to the invention is defined by point 1 below.

1. A method of assembly of a watch pivot device or a watch mechanism or a watch movement or a timepiece, the watch pivot device or the watch mechanism or the watch movement or the timepiece comprising a pivot and a bearing, the method comprising the following stages:
   supplying the pivot;
   supplying the bearing;
   applying, to at least one surface of the pivot and/or of the bearing, a lubricant of which the kinematic viscosity at a temperature of 20° C. is greater than 1.5 St;
   positioning the pivot in the bearing.

Different embodiments of the method of assembly are defined by points 2 to 5 below.

2. The method as defined in the preceding point, wherein the lubricant is a polyalphaolefin-based lubricant.
3. The method as defined in one of the preceding points, wherein the kinematic viscosity of the lubricant at a temperature of 20° C. is greater than 1.6 St or 1.7 St or 1.8 St or 1.9 St or 2 St or 2.2 St or 2.5 St or 3 St or 4 St or 5 St or 6 St or 7 St or 8 St or 9 St or 10 St or 11 St or 12 St or 14 St or 16 St or 18 St or 20 St or 25 St or 30 St or 35 St or 40 St and/or wherein the kinematic viscosity of the lubricant at a temperature of 20° C. is lower than 50 St or 40 St or 35 St or 30 St or 25 St or 20 St or 18 St or 16 St or 14 St or 12 St or 11 St or 10 St or 9 St or 8 St or 7 St or 6 St or 5 St.
4. The method as defined in one of the preceding points, wherein the pivot is a balance staff pivot of an oscillator of the balance wheel and hairspring type, more particularly an oscillator of the balance wheel and hairspring type having a frequency of oscillation greater than or equal to 3 Hz, or greater than or equal to 4 Hz, and/or wherein the bearing comprises at least one jewel, more particularly a ruby.

5. The method as defined in one of the preceding points, wherein the pivot is a pivot of an element of which the mass is greater than $5\times10^{-2}$ g and/or of which the moment of inertia is greater than $5\times10^{-10}$ kg·m$^2$.

The pivot device or the watch mechanism or the watch movement or the timepiece according to the invention is defined by point 6 below.

6. A watch pivot device or a watch mechanism or a watch movement or a timepiece, obtained by the implementation of a method as defined in one of the preceding points.

The pivot device according to the invention is also defined by point 7 below.

7. A watch pivot device comprising a pivot and a bearing, at least one surface of the pivot and/or of the bearing being coated with a lubricant of which the kinematic viscosity at a temperature of 20° C. is greater than 1.5 St.

Different embodiments of the pivot device are defined by points 8 to 11 below.

8. The device as defined in point 6 or 7, wherein the lubricant is a polyalphaolefin-based lubricant.

9. The device as defined in one of points 6 to 8, wherein the kinematic viscosity of the lubricant at a temperature of 20° C. is greater than 1.6 St or 1.7 St or 1.8 St or 1.9 St or 2 St or 2.2 St or 2.5 St or 3 St or 4 St or 5 St or 6 St or 7 St or 8 St or 9 St or 10 St or 11 St or 12 St or 14 St or 16 St or 18 St or 20 St or 25 St or 30 St or 35 St or 40 St and/or wherein the kinematic viscosity of the lubricant at a temperature of 20° C. is lower than 50 St or 40 St or 35 St or 30 St or 25 St or 20 St or 18 St or 16 St or 14 St or 12 St or 11 St or 10 St or 9 St or 8 St or 7 St or 6 St or 5 St.

10. The device as defined in one of points 6 to 9, wherein the pivot is a balance staff pivot of an oscillator of the balance wheel and hairspring type, more particularly an oscillator of the balance wheel and hairspring type having a frequency of oscillation greater than or equal to 3 Hz, or greater than or equal to 4 Hz, and/or wherein the bearing comprises at least one jewel, more particularly a ruby.

11. The device as defined in one of points 6 to 10, wherein the pivot is a pivot of an element of which the mass is greater than $5\times10^{-2}$ g and/or of which the moment of inertia is greater than $5\times10^{-10}$ kg·m$^2$.

The watch mechanism according to the invention is defined by point 12 below.

12. A watch mechanism comprising a device as defined in one of points 6 to 11.

The watch movement according to the invention is defined by point 13 below.

13. A watch movement comprising a device as defined in one of points 6 to 11 or a mechanism as defined in the preceding point.

The timepiece according to the invention is defined by point 14 below.

14. A timepiece, more particularly a wristwatch, comprising a movement as defined in the preceding point or a mechanism as defined in point 12 or a device as defined in one of points 6 to 11.

The accompanying figures depict, by way of example, an embodiment of a timepiece according to the invention.

Figure 1:
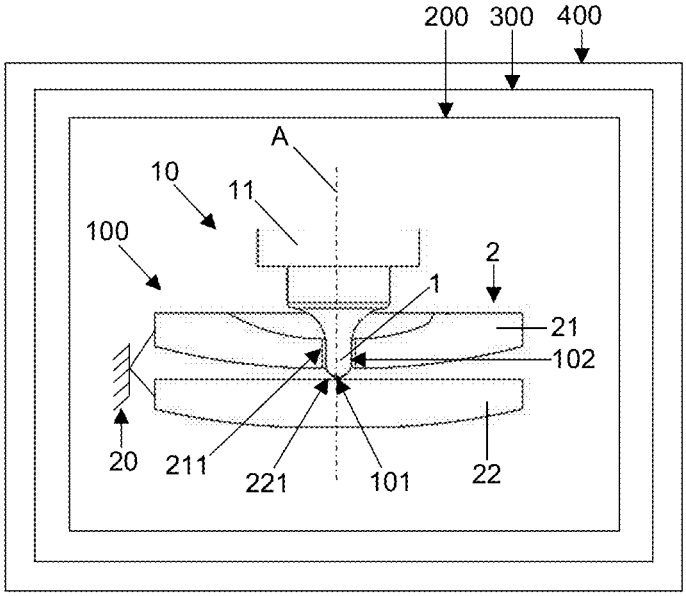
FIGS. 1 and 2 are schematic views of the embodiment of a timepiece, the timepiece being respectively in the "flat" position and in the "suspended" position.
Figure 2:
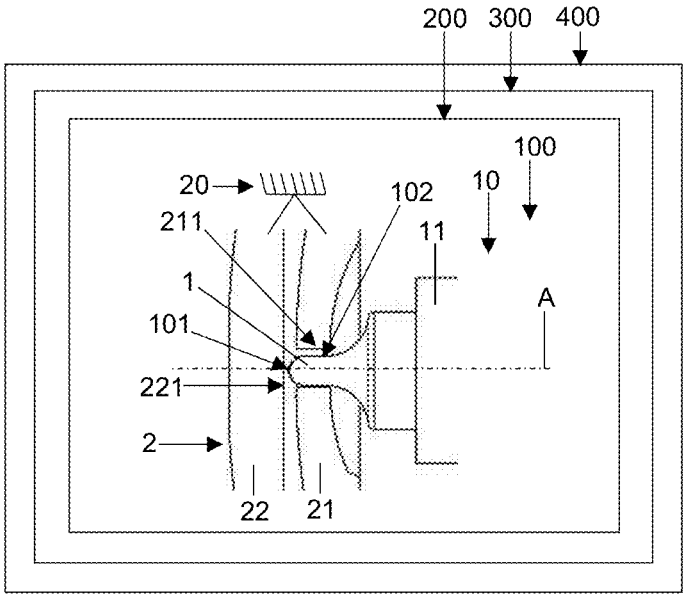

One embodiment of a timepiece 400 is described below with reference to FIGS. 1 and 2. The timepiece is a watch, for example, more particularly a wristwatch. The timepiece comprises a mechanical watch movement 300. The watch movement comprises a mechanism 200, more particularly an oscillator 200 of the balance wheel and hairspring type.

The mechanism or the oscillator comprises at least one, and more particularly two, pivot devices 100. These pivot devices make it possible to pivot the balance 10 on a frame 20 of the mechanism or the movement about an axis A.

The balance comprises a staff 11, itself comprising at least one pivot 1 and more particularly two pivots, each being situated at one extremity of the staff.

The mechanism 200 or the movement 300 comprises the frame 20. The frame 20 is equipped with at least one bearing 2 intended to cooperate with a pivot or intended to receive a pivot. The frame preferably comprises two bearings 2, each bearing cooperating with a pivot or receiving a pivot. A first bearing is mounted, for example, on a plate of the frame, and a second bearing is mounted, for example, on a bridge of the frame.

The bearing 2 or each bearing advantageously comprises a pivot jewel 21 and a counter-pivot jewel 22. The bearing or each bearing advantageously constitutes part of a shock absorber.

The pivot comprises an end surface 101, more particularly a curved or hemispherical surface 101, and a lateral surface 102, more particularly a cylindrical surface 102. The pivot may be integrally formed with the balance staff 11.

The bearing 2 comprises a pivot jewel 21 having a surface 211 in the form of a flank of a circular hole, more particularly an olive surface, and a counter-pivot jewel 22 having a surface 221, more particularly a plane surface.

The surfaces 101 and 221 are intended to cooperate by contact in order to guide the oscillator as it pivots, more particularly into a "flat" position of the timepiece.

The surfaces 102 and 211 are intended to cooperate by contact in order to guide the oscillator as it pivots, more particularly into a "suspended" position of the timepiece.

The watch pivot device 100 comprises the pivot 1 and a bearing 2.

At least one surface of the pivot 101, 102 and/or one surface of the bearing 211, 221 is coated with a lubricant, of which the kinematic viscosity at a temperature of 20° C. is greater than or equal to 1.5 St.

Preferably, all the surfaces 101, 102, 211 and 221 involved in the guiding of the oscillator are coated with a lubricant, of which the kinematic viscosity at a temperature of 20° C. is greater than or equal to 1.5 St.

The lubricant is preferably an oil or a grease.

Furthermore, the lubricant may or may not be free from additives.

The kinematic viscosity of the lubricant at a temperature of 20° C. is advantageously greater than or equal to 1.6 St or 1.7 St or 1.8 St or 1.9 St or 2 St or 2.2 St or 2.5 St or 3 St or 4 St or 5 St or 6 St or 7 St or 8 St or 9 St or 10 St or 11 St or 12 St or 14 St or 16 St or 18 St or 20 St or 25 St or 30 St or 35 St or 40 St.

As an alternative or in addition, the kinematic viscosity of the lubricant at a temperature of 20° C. is advantageously lower than or equal to 50 St or 40 St or 35 St or 30 St or 25 St or 20 St or 18 St or 16 St or 14 St or 12 St or 11 St or 10 St or 9 St or 8 St or 7 St or 6 St or 5 St.

The pivot is preferably a balance staff pivot of an oscillator of the balance wheel and hairspring type having a frequency of oscillation greater than or equal to 3 Hz, or greater than or equal to 4 Hz.

As seen previously, the bearing advantageously comprises one or a plurality of jewels, more particularly one or a plurality of jewels made of ruby.

Preferably, the pivot is a pivot of an element, more particularly of the balance wheel, of which the mass is greater than $5\times10^{-2}$ g or of which the moment of inertia is greater than $5\times10^{-10}$ kg·m$^2$.

One embodiment of a method of assembly of a watch pivot device 100 as described previously, or of a mechanism 200 as described previously, or of a movement 300 as described previously, or of a timepiece 400 as described previously is disclosed below.

The method comprises the following stages:

supplying the pivot 1;

supplying the bearing 2;

applying, to at least one surface 101, 102, 211, 221 of the pivot and/or of the bearing, a lubricant of which the kinematic viscosity at a temperature of 20° C. is greater than 1.5 St;

positioning the pivot in the bearing.

The order of the last two stages does not matter. The lubricant may be applied before or after the positioning of the pivot in the bearing.

The method may be implemented during a phase of production of a movement or a timepiece.

Alternatively, the method may also be implemented during a maintenance phase of the movement or the timepiece, more particularly in the course of service or repair operations.

Studies conducted by the applicant have revealed that it is possible, surprisingly, to harmonize the coefficients of friction of the pivot devices described previously by appropriate lubrication. More particularly, the studies show that the use of a lubricant having a kinematic viscosity (referred to more simply as "viscosity" in the rest of the document) in a given range makes it possible to obtain a significant reduction in the difference in the quality factor between the horizontal ("flat") positions and the vertical ("suspended") positions of the movement.

Although, in horizontal positions (CH, FH) of the movement, the greater the viscosity of the lubricant, the higher the resistive torque or the frictional torque prevailing within the pivot device of the oscillator, tests reveal that the same is not true for the inclined positions of the movement, and more particularly for the vertical positions of the movement. In fact, the coefficient of friction does not depend solely on the viscosity of the lubricant used, but also more particularly on the speed of the oscillator and on the load applied against the bearing of the oscillator, and therefore more particularly on the mass, in particular on the inertia of the oscillator. It is therefore possible, more particularly for a given speed and a given inertia of the oscillator, to define an advantageous range of viscosity of a lubricant, which makes it possible to harmonize as far as possible the frictional torque of the pivot device of an oscillator according to the different positions that the watch is likely to adopt when it is being worn. This range of viscosity extends between 1.5 St and 50 St at 20° C.

These conclusions derive from experimental measures conducted in two distinct phases. Five additive-free oils from the same chemical family, of which only the viscosity differs, are considered in a first phase. For each of them, quality factors are measured for different positions of a movement, of which the pivot device of the oscillator is already well-oiled. Four additive-containing oils, of which the viscosity differs, are considered in a second phase. For each of them, quality factors are measured for different positions of a movement, of which the pivot device of the oscillator is already well-oiled. In each of the phases, an additive-containing lubricant under the denomination SAL 9010 (9010) from the Moebius company serves as a reference. The movement under consideration is a Rolex movement of type 3130 equipped with a 4 Hz oscillator, of which the balance wheel has an inertia of $14\times10^{-10}$ kg·m$^2$. In each of the phases, ten samples of a Rolex movement of type 3130 were the subject of measurements.

The measurements are performed without an escapement by means of an automated device allowing values for the quality factor (FQ) of an oscillator to be obtained for a given range of oscillations and for a range of given positions of the movement. The movement thus scans through different watch positions, from the FH position (reference position at 0° of inclination, balance shaft vertical) to the CH position (rotation through 180°, balance shaft vertical) passing through the 6H position (rotation through 90°, balance shaft horizontal), by increments of 10°. A strict protocol for cleaning the pivot device of the oscillator is performed between the various lubrications in order to thoroughly clean the molecules of the previous lubricants and, in particular, the molecules of the additives, with the aim of measuring only the effect of the oil under consideration without being influenced by the others. After ultrasonic cleaning, the pivot device is immersed successively in different baths. The new lubricant is not applied until after this cleaning protocol.

In the first phase, the five additive-free lubricants (apart from the reference lubricant) under consideration are synthetic-based oils of the PAO (Poly Alpha Olefin) type, which have different viscosities:

a first oil A has a viscosity of 1.3 St at 20° C.;

a second oil B has a viscosity of 7.1 St at 20° C.;

a third oil C has a viscosity of 12.9 St at 20° C.;

a fourth oil D has a viscosity of 21.4 St at 20° C.;

a fifth oil E has a viscosity of 44 St at 20° C.

The viscosity of the 9010 reference oil used has a viscosity of 1.2 St at 20° C.

Figure 3:
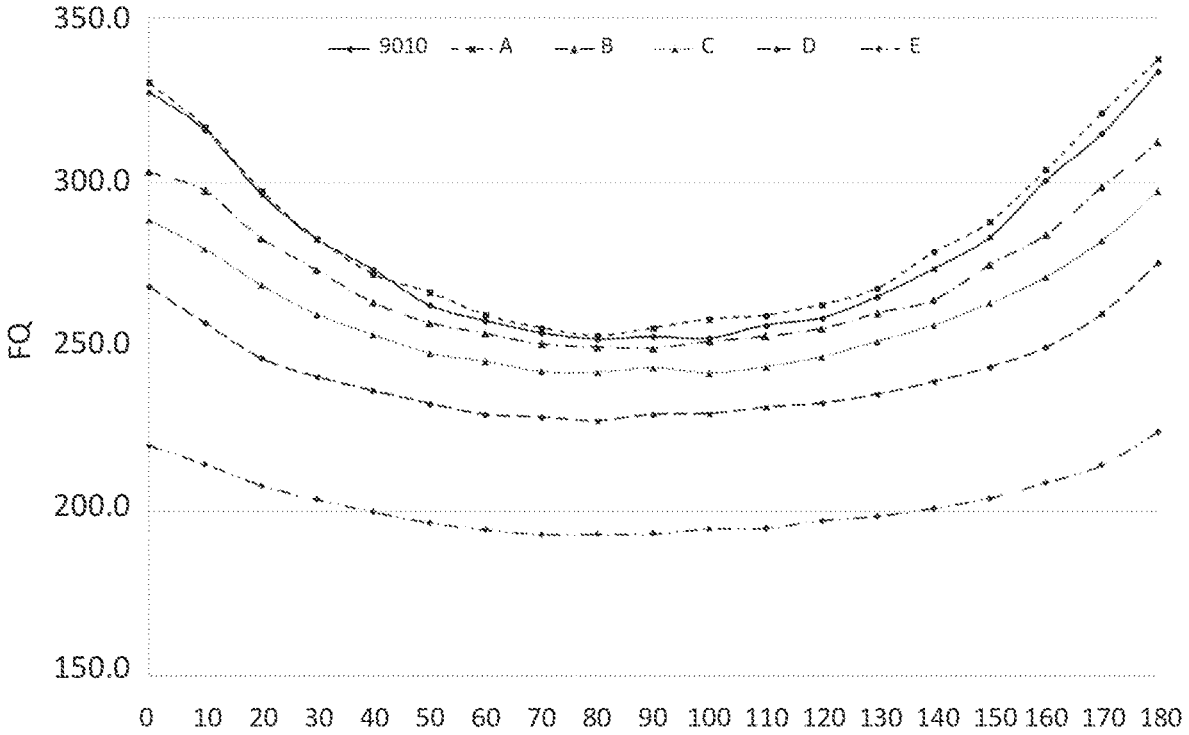
FIG. 3 is a graph depicting the changes in the quality factor of a timepiece, depending on its position, for different lubricants used in the pivot devices of oscillators.

FIG. 3 depicts, for each of the lubricants, curves showing the change in the quality factor (FQ), for a reference amplitude of the oscillator at 280°, depending on the different positions (P) of the movement. This reference amplitude is considered as being representative of a movement when worn and representative of the effects of the lubricants on the pivot device of the oscillator. For each of the positions of the movement, the values for the quality factor are averages obtained on the basis of the measurements performed on each of the samples of the movement of type 3130.

Figure 4:
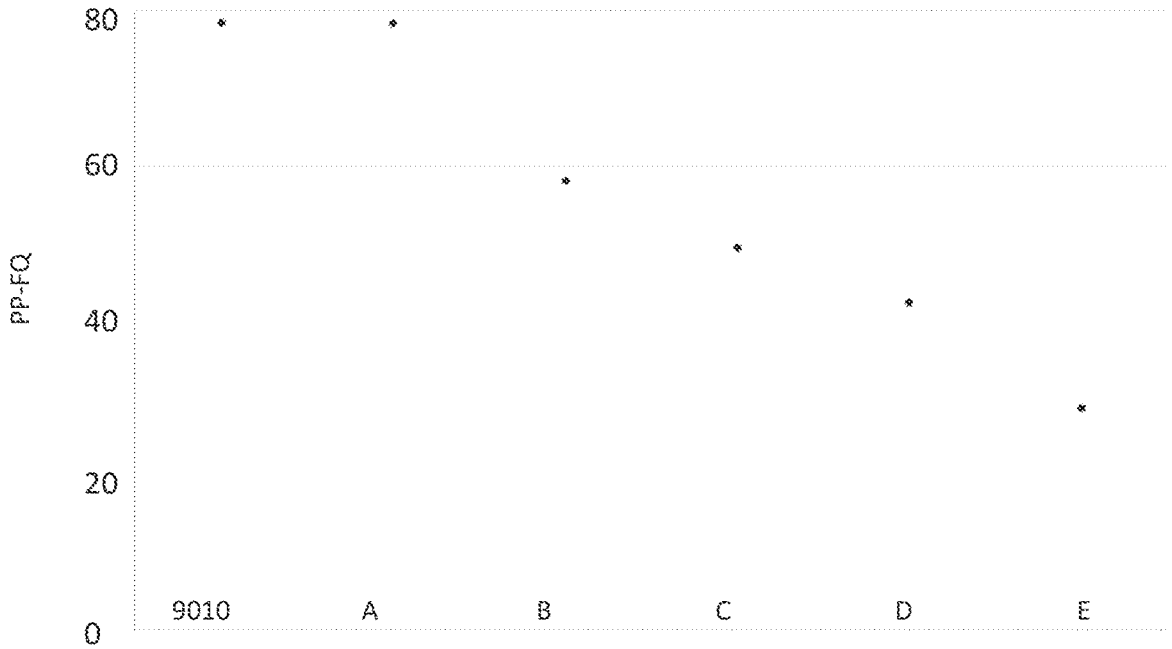
FIG. 4 is a graph depicting the differences between the average of the quality factors for positions CH and FH and the quality factor in the 6H position of the timepiece for the different lubricants, these differences being plotted in FIG. 3.

These curves each have a parabolic appearance. They are downward for a movement which proceeds from the FH position (0°) to the 6H position (90°), and they are then upward for a movement which proceeds from the 6H position (90°) to the CH position (180°). In horizontal positions (FH and CH) and for low inclinations of the movement, it has been observed that, the greater the viscosity of the lubricant, the lower the quality factors. In these configurations of the movement, oils 9010 and A give better values for the quality factor (respectively 327 and 334 in the FH and CH positions for oil 9010, and respectively 330 and 338 in the FH and CH positions for oil A). These are followed by oil B (respectively 303 and 312 in the FH and CH positions), oil C (respectively 289 and 297 in the FH and CH positions), oil D (respectively 268 and 275 in the FH and CH positions), and finally oil E (respectively 220 and 224 in the FH and CH positions). For larger inclinations of the movement, it has been noted that the values for quality factors become substantially tighter between the different lubricants, more particularly between lubricant 9010, lubricant A, and lubricants B and C. In the 6H position in particular, whereas oils 9010 and A give quality factor values which are respectively 253 and 256, oil B gives a quality factor value of 249, and oil C gives a quality factor value of 243. A direct consequence of these observations concerns the flat hanging difference of the quality factor (PP-FQ), that is to say the difference between the average of the quality factors for the CH and FH positions and the quality factor in the 6H position. At the reference amplitude of 280°, the flat hanging differences of the quality factor of oils B, C and D, between 40 and 60, are significantly lower than the flat hanging differences of the quality factor of oils 9010 and A, which tend towards 80 (FIG. 4). The flat hanging difference of the quality factor PP-FQ of oil E, for its part, is even smaller with a value in the order of 30.

In general, it has been observed that the quality factor of the oscillator is less sensitive to the positions of the movement with lubricants B, C and D than with lubricants A and 9010, while still being sufficiently high, in the order of 230 to 320, to permit good chronometric and/or energetic performances of the oscillator. Oil C gives particularly good results with a flat hanging difference of the quality factor in the order of 50, and with quality factor values between 242 and 297. In other words, the frictional torque prevailing within the pivot device lubricated by oil C is sufficiently low to obtain satisfactory quality factors and varies sufficiently little to obtain homogeneous quality factors regardless of the positions of the movement, and accordingly a low PP-FQ.

In the second phase, the four lubricants (apart from the reference lubricant) under consideration are additive-containing oils of the HP type, which have different viscosities:

- a sixth oil Synt-HP500 (HP500) from the manufacturer Moebius, having a viscosity of 5 St at 20° C.;
- a seventh oil Synt-HP750 (HP750) from the manufacturer Moebius, having a viscosity of 7.5 St at 20° C.;
- an eighth oil Synt-HP1000 (HP1000) from the manufacturer Moebius, having a viscosity of 10 St at 20° C.;
- a ninth oil Synt-HP1300 (HP1300) from the manufacturer Moebius, having a viscosity of 13 St at 20° C.

The viscosity of the SAL 9010 reference oil used has a viscosity of 1.2 St at 20° C.

Figure 5:
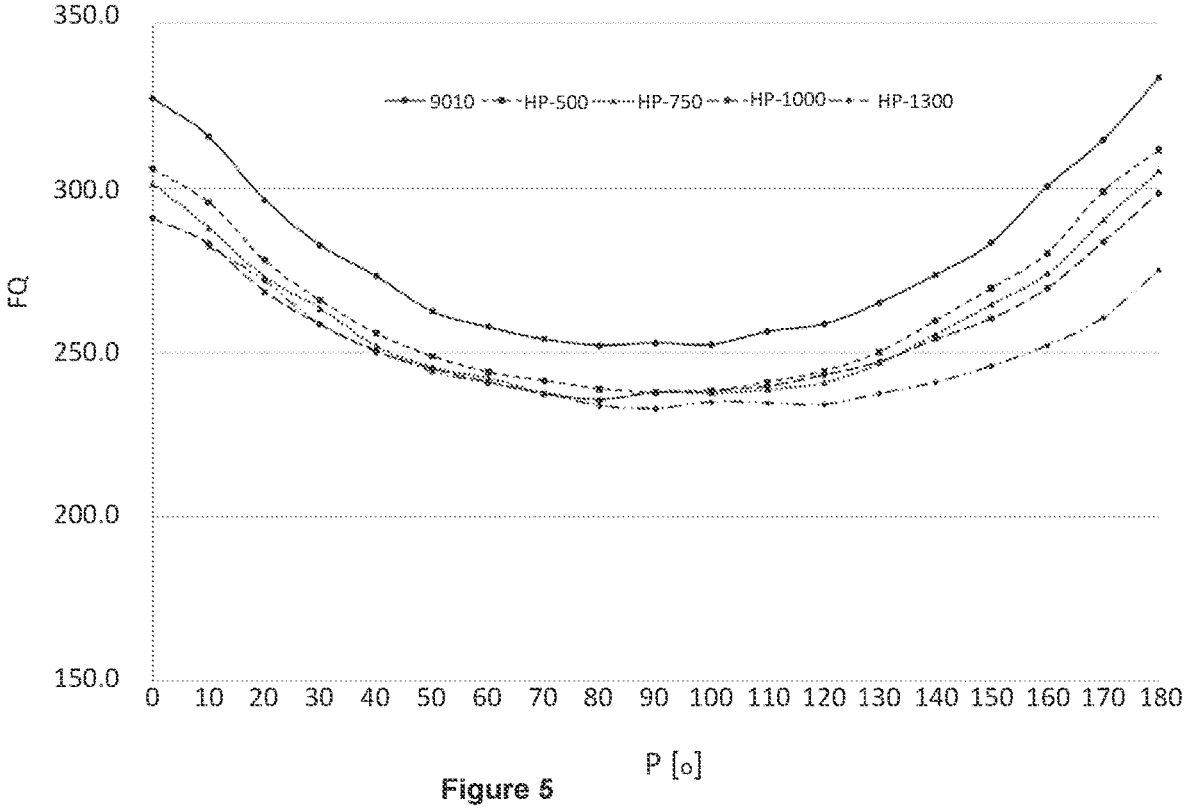
FIG. 5 is a graph depicting the changes in the quality factor of a timepiece, depending on its position, for different lubricants used in the pivot devices of oscillators.

FIG. 5 depicts, for each of the lubricants, curves showing the change in the quality factor (FQ), for a reference amplitude of the oscillator at 280°, depending on the different positions (P) of the movement. For each of the positions of the movement, the values for the quality factor are averages obtained on the basis of the measurements performed on each of the samples of the movement of type 3130.

Along similar lines to what has been seen previously, these curves each have a parabolic appearance. They are downward for a movement which proceeds from the FH position (0°) to the 6H position (90°), and they are then upward for a movement which proceeds from the 6H position (90°) to the CH position (180°). In horizontal positions (FH and CH) and for low inclinations of the movement, it has also been observed that, the greater the viscosity of the lubricant, the lower the quality factors. In these configurations of the movement, oil 9010 gives better values for the quality factor (respectively 327 and 334 in the FH and CH positions). This is followed by oil HP500 (respectively 306 and 312 in the FH and CH positions), oil HP750 (respectively 301 and 305 in the FH and CH positions), oil HP1000 (respectively 291 and 299 in the FH and CH positions), and finally oil HP1300 (respectively 282 and 287 in the FH and CH positions). For larger inclinations of the movement, it has been noted that the values for quality factors become substantially tighter between the different lubricants, more particularly becoming significantly tighter between the different lubricants of type HP.

Figure 6:
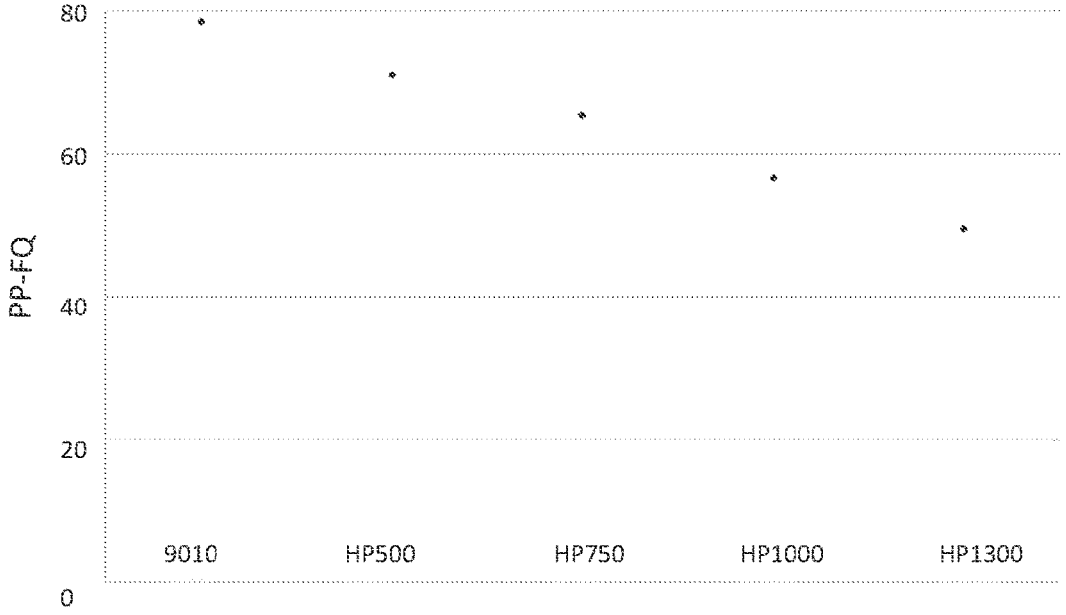
FIG. 6 is a graph depicting the differences between the average of the quality factors for the CH and FH positions and the quality factor in the 6H position of the timepiece for the different lubricants, these differences being plotted in FIG. 5.

In the 6H position in particular, the quality factor values of the oils of type HP lie between 235 and 238. At the reference amplitude of 280°, the flat hanging differences of the quality factor PP-FQ of oils of type HP, lying between 50 and 70, are lower than that of oil 9010, which tends towards 80 (FIG. 6).

In general, it has been observed that the quality factor of the oscillator is less sensitive to the positions of the movement with lubricants of type HP, while being sufficiently high, in the order of 230 to 315, to permit good chronometric and/or energetic performances of the oscillator. In other words, the frictional torques prevailing within the pivot devices lubricated by oils of type HP are sufficiently low to obtain satisfactory quality factors and vary sufficiently little to obtain homogeneous quality factors, regardless of the positions of the movement, and accordingly a low flat hanging difference for the quality factor PP-FQ.

Irrespective of the phase under consideration, it appears that the flat hanging difference of the quality factor of the oscillator depends to a very considerable degree on the viscosity of the lubricant used. Whether or not the lubricant contains additives, it is possible to cause the flat hanging difference of the quality factor of the oscillator to vary by causing the viscosity of the lubricant used to vary.

More particularly, it is possible to cause the flat hanging difference of the quality factor of the oscillator to vary, notably to decrease, by causing the viscosity of a polyalphaolefin-based lubricant (PAO) to vary. "Polyalphaolefin-based lubricant" preferably means a lubricant of which the main components are polyalphaolefin components or a lubricant including more that 60% of polyalphaolefin components by weight.

Additionally, a suchlike lubricant may or may not contain additives in the form of friction modifier additives and/or antioxidant additives and/or anti-wear additives, in order to satisfy predefined performance and reliability objectives, more particularly chronometric performance and reliability objectives. Of course, this list is not restrictive.

As compared to a reference lubricant (oil A or Synt-A-Lube (SAL) 9010 oil from the manufacturer Moebius), it can be noticed that a lubricant having a viscosity of at least 5 St at 20° C. allows to decrease the flat hanging difference of the quality factor by at least 10%.

As compared to a reference lubricant (oil A) and based on the parabolic regression curve (FIG. 7) relating to polyalphaolefin-based lubricants, it can be noticed that a polyalphaolefin-based lubricant having a viscosity of at least 1.8 St at 20° C. allows to decrease the flat hanging difference of the quality factor by at least 7%.

As compared to a reference lubricant (oil A) and based on the parabolic regression curve (FIG. 7) relating to polyalphaolefin-based lubricants, it can be noticed that a polyalphaolefin-based lubricant having a viscosity of at least 2.2 St at 20° C. allows to decrease the flat hanging difference of the quality factor by at least 8%.

As compared to a reference lubricant (oil A) and based on the parabolic regression curve (FIG. 7) relating to polyalphaolefin-based lubricants, it can be noticed that a polyalphaolefin-based lubricant having a viscosity of at least 3 St at 20° C. allows to decrease the flat hanging difference of the quality factor by at least 10%.

As compared to a reference lubricant (oil A) and based on the parabolic regression curve (FIG. 7) relating to polyalphaolefin-based lubricants, it can be noticed that a polyalphaolefin-based lubricant having a viscosity of at least 5 St at 20° C. allows to decrease the flat hanging difference of the quality factor by at least 15%.

As compared to a reference lubricant (oil A) and based on the parabolic regression curve (FIG. 7) relating to polyalphaolefin-based lubricants, it can be noticed that a polyalphaolefin-based lubricant having a viscosity of at least 6 St at 20° C. allows to decrease the flat hanging difference of the quality factor by at least 20%.

Figure 7:
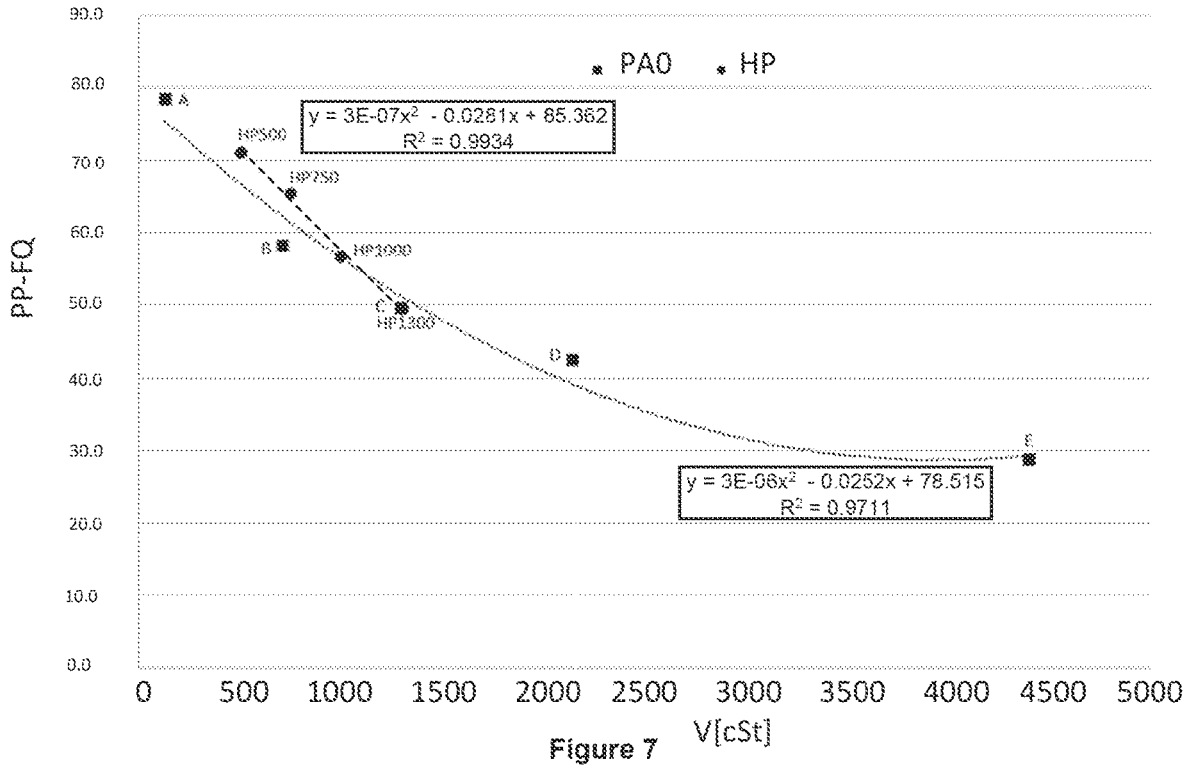
FIG. 7 is a graph depicting the differences between the average of the quality factors for the CH and FH positions and the quality factor in the 6H position of the timepiece as a function of the viscosity of the lubricants used in the pivot devices of oscillators.

As compared to a reference lubricant (oil A) and based on the interpolation line crossing points A and B on FIG. 7, it can be noticed that a polyalphaolefin-based lubricant having a viscosity of at least 1.5 St at 20° C. allows to decrease the flat hanging difference of the quality factor by at least 1%.

As compared to a reference lubricant (oil A) and based on the interpolation line crossing points A and B on FIG. 7, it can be noticed that a polyalphaolefin-based lubricant having a viscosity of at least 1.6 St at 20° C. allows to decrease the flat hanging difference of the quality factor by at least 2%.

As compared to a reference lubricant (oil A) and based on the interpolation line crossing points A and B on FIG. 7, it can be noticed that a polyalphaolefin-based lubricant having a viscosity of at least 1.8 St at 20° C. allows to decrease the flat hanging difference of the quality factor by at least 3%.

As compared to a reference lubricant (oil A) and based on the interpolation line crossing points A and B on FIG. 7, it can be noticed that a polyalphaolefin-based lubricant having a viscosity of at least 2 St at 20° C. allows to decrease the flat hanging difference of the quality factor by at least 4%.

As compared to a reference lubricant (oil A) and based on the interpolation line crossing points A and B on FIG. 7, it can be noticed that a polyalphaolefin-based lubricant having a viscosity of at least 2.2 St at 20° C. allows to decrease the flat hanging difference of the quality factor by at least 5%.

As compared to a reference lubricant (oil A) and based on the interpolation line crossing points A and B on FIG. 7, it can be noticed that a polyalphaolefin-based lubricant having a viscosity of at least 3 St at 20° C. allows to decrease the flat hanging difference of the quality factor by at least 8%.

As compared to a reference lubricant (oil A) and based on the interpolation line crossing points A and B on FIG. 7, it can be noticed that a polyalphaolefin-based lubricant having a viscosity of at least 5 St at 20° C. allows to decrease the flat hanging difference of the quality factor by at least 15%.

As compared to a reference lubricant (oil A) and based on the interpolation line crossing points A and B on FIG. 7, it can be noticed that a polyalphaolefin-based lubricant having a viscosity of at least 6 St at 20° C. allows to decrease the flat hanging difference of the quality factor by at least 20%.

Figure 8:
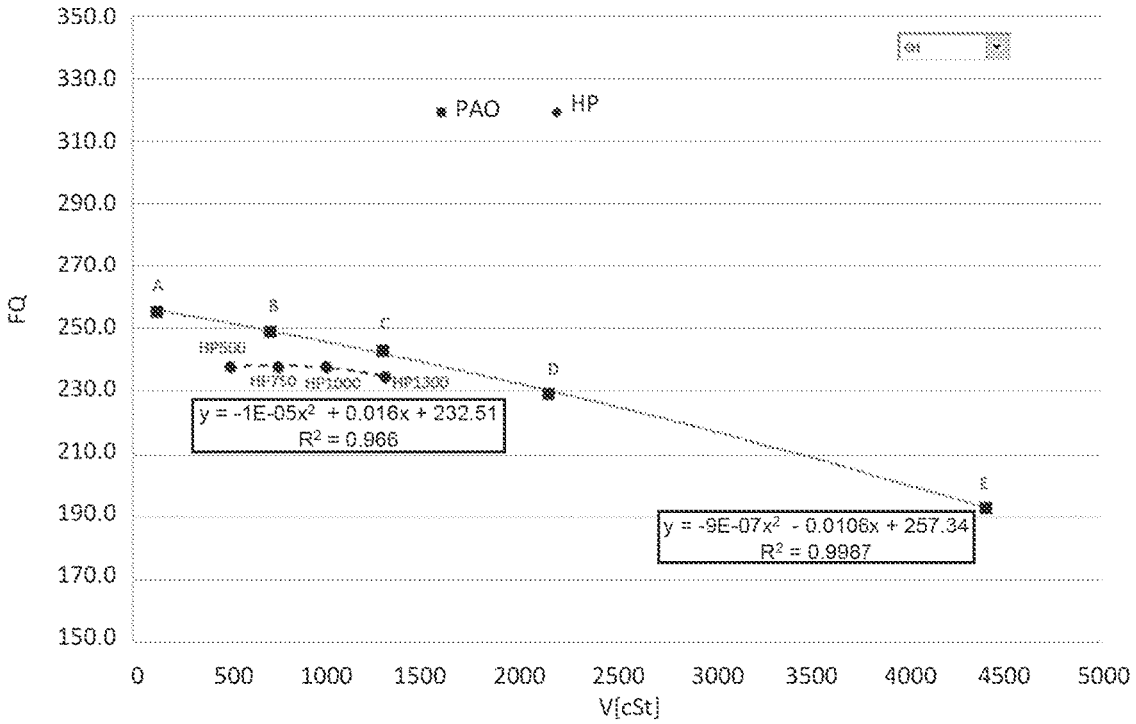
FIG. 8 is a graph depicting the changes in the quality factor of a timepiece in the 6H position, as a function of the viscosity of the lubricants used in the pivot devices of oscillators.

As compared to a reference lubricant (Synt-A-Lube (SAL) 9010 oil from the manufacturer Moebius) and based on the curves on FIG. 8, it can be noticed that a lubricant having a viscosity of less than 14 St at 20° C. allows to not decrease the quality factor by more than 20%.

As compared to a reference lubricant (Synt-A-Lube (SAL) 9010 oil from the manufacturer Moebius) and based on the curves on FIG. 8, it can be noticed that a lubricant having a viscosity of less than 5 St at 20° C. allows to not decrease the quality factor by more than 15%.

As compared to a reference lubricant (Synt-A-Lube (SAL) 9010 oil from the manufacturer Moebius) and based on the parabolic regression curve (FIG. 8) relating to polyalphaolefin-based lubricants, it can be noticed that a polyalphaolefin-based lubricant having a viscosity of less than 12 St at 20° C. allows to not decrease the quality factor by more than 10%.

As compared to a reference lubricant (Synt-A-Lube (SAL) 9010 oil from the manufacturer Moebius) and based on the parabolic regression curve (FIG. 8) relating to polyalphaolefin-based lubricants, it can be noticed that a polyalphaolefin-based lubricant having a viscosity of less than 5 St at 20° C. allows to not decrease the quality factor.

As compared to a reference lubricant (Synt-A-Lube (SAL) 9010 oil from the manufacturer Moebius) and based on the parabolic regression curve (FIG. 8) relating to polyalphaolefin-based lubricants, it can be noticed that a polyalphaolefin-based lubricant having a viscosity of less than 8 St at 20° C. allows to not decrease the quality factor by more than 5%.

The invention may also be applied to another type of pivot device or to a pivot device adapted to pivot an element other than a balance wheel.

The invention claimed is:

1. A method of assembly of a watch pivot device or a watch mechanism or a watch movement or a timepiece, the watch pivot device or the watch mechanism or the watch movement or the timepiece comprising a pivot and a bearing, in a manner to reduce the coefficients of friction between the pivot and the bearing in horizontal positions and vertical positions of the pivot during use by applying a lubricant having a particular kinematic viscosity in relation to a moment of inertia of the pivot, the method comprising:

supplying the pivot;

supplying the bearing;

applying, to at least one surface of the pivot and/or of the bearing, a lubricant of which the kinematic viscosity at a temperature of 20° C. is greater than 1.5 St and lower than 50 St; and positioning the pivot in the bearing, wherein the lubricant applies a higher resistive torque between the pivot and the bearing in the horizontal position of the pivot in comparison to the vertical position of the pivot such that frictional torque between the pivot and the bearing is harmonized regardless of a position of the pivot between the horizontal position to the vertical position of the pivot.

2. The method as claimed in claim 1, wherein the lubricant is a polyalphaolefin-based lubricant.

3. The method as claimed in claim 1, wherein the kinematic viscosity of the lubricant at a temperature of 20° C. is greater than 1.6 St.

4. The method as claimed in claim 1, wherein the pivot is a balance staff pivot of an oscillator.

5. The method as claimed in claim 4, wherein the oscillator includes a balance wheel or a hairspring.

6. The method as claimed in claim 1, wherein the pivot is a pivot of an element having a mass greater than $5\times10^{-2}$ g.

7. A watch pivot device or a watch mechanism or a watch movement or a timepiece, obtained by the implementation of a method as claimed in claim 1.

8. The device as claimed in claim 7, wherein the lubricant is a polyalphaolefin-based lubricant.

9. The device as claimed in claim 7, wherein the kinematic viscosity of the lubricant at a temperature of 20° C. is greater than 1.6 St.

10. The device as claimed in claim 7, wherein the pivot is a balance staff pivot of an oscillator.

11. The device as claimed in claim 10, wherein the oscillator includes a balance wheel or a hairspring.

12. The device as claimed in claim 7, wherein the pivot is a pivot of an element having a mass greater than $5\times10^{-2}$ g.

13. A watch mechanism comprising a device as claimed in claim 7.

14. A watch movement comprising a mechanism as claimed in claim 13.

15. A timepiece comprising a movement as claimed in claim 14.

16. The device as claimed in claim 7, wherein the bearing comprises at least one jewel.

17. The method as claimed in claim 1, wherein the bearing comprises at least one jewel.

18. The method as claimed in claim 1, wherein the pivot is a pivot of an element having a moment of inertia greater than $5\times10^{-10}$ kg·m$^2$.

19. A watch pivot device comprising a pivot and a bearing, at least one surface of the pivot and/or of the bearing being coated with a lubricant of which the kinematic viscosity at a temperature of 20° C. is greater than 1.5 St, wherein the lubricant applies a higher resistive torque between the pivot and the bearing in the horizontal position of the pivot in comparison to the vertical position of the pivot such that frictional torque between the pivot and the bearing is harmonized regardless of a position of the pivot between the horizontal position to the vertical position of the pivot.

* * * * *